United States Patent [19]

Treppner

[11] Patent Number: 4,669,227

[45] Date of Patent: Jun. 2, 1987

[54] ANGLE PLATE APPARATUS WITH PRECISELY ADJUSTABLE WORKPIECE HOLDER

[76] Inventor: Bernaht C. Treppner, 4537 W. Gardenia Ave., Glendale, Ariz. 85301

[21] Appl. No.: 747,860

[22] Filed: Jun. 24, 1985

[51] Int. Cl.[4] ..... B24B 41/06

[52] U.S. Cl. ..... 51/217 R; 51/216 A; 51/217 A; 51/221 R; 269/900; 269/902; 33/537; 33/570; 125/11 R

[58] Field of Search ..... 51/216 R, 216 A, 217 R, 51/217 A, 218 A, 220–221; 269/900, 902; 125/11 R, 11 AT; 33/536–537, 568–570, 573

[56] References Cited

U.S. PATENT DOCUMENTS

| | | | |
|---|---|---|---|
| 1,705,629 | 3/1929 | Wildbore | 51/220 |
| 2,366,385 | 1/1945 | Cormfort | 51/217 R |
| 2,378,743 | 6/1945 | Wisne | 33/536 X |
| 2,730,846 | 1/1956 | Heineman | 51/220 X |
| 2,756,508 | 7/1956 | O'Grady et al. | 33/537 |
| 2,842,905 | 7/1958 | Rolin | 51/216 R |
| 3,137,288 | 6/1964 | Soulios | 125/11 R |
| 3,621,620 | 3/1969 | Kinder et al. | 51/217 R X |
| 3,824,744 | 7/1974 | Petrant | 51/217 A |

FOREIGN PATENT DOCUMENTS

| | | | |
|---|---|---|---|
| 584685 | 1/1947 | United Kingdom | 51/216 A |

*Primary Examiner*—Frederick R. Schmidt
*Assistant Examiner*—Debra S. Meislin
*Attorney, Agent, or Firm*—Herbert E. Haynes, Jr.

[57] ABSTRACT

An especially configured angle plate apparatus having a workpiece holder mounted thereon for precision positioning of the workpiece holder relative to a supporting surface. The angle plate and workpiece holder are cooperatively adapted so that the workpiece holder may be precisely and selectively positioned in parallel relationship with the supporting surface, perpendicular relationship with the supporting surface and angular relationships with the supporting surface and all at adjustable distances relative to the supporting surfaces. The angle plate apparatus is also provided with fixed V-block structures and an adjustably movable V-block structure for holding and supporting workpieces and a special grind stone dressing tool for precision dressing of a grind stone.

16 Claims, 8 Drawing Figures

ANGLE PLATE APPARATUS WITH PRECISELY ADJUSTABLE WORKPIECE HOLDER

BACKGROUND OF THE INVENTION

1. Field of the Invention

This invention relates in general to devices used in the machining industry for holding and precision positioning of workpieces and more particularly to a multi-purpose angle plate apparatus having a precisely adjustable workpiece holder.

2. Description of the Prior Art

Various devices are used by the machining industry for holding and precision positioning of workpieces relative to machine tools, grind stones, and the like. Among such devices is the well known angle plate which basically includes two integrally formed plates disposed at a right angle with respect to each other. The primary intended usage of such angle plates, in so far as workpiece holding and positioning is concerned, is for flat placement of one of the plates on a supporting surface and mounting of a workpiece directly on the other upstanding plate. Angle plates are highly precision structures with regards to the angular relationship of the two plates, squareness and parallelism of the side and the edge surfaces and the like, and this allows them to be positioned in various attitudes in addition to the basic position discussed briefly above. Some of these variously configured angle plates are provide with V-grooves in the end surface of one, or both, or the plates, with the V-shaped grooves being provided for clamped attachment of workpieces therein. When workpieces are mounted in the V-grooves and the angle plate is supported in the basic position discussed above, on a support surface, such as the workbed of a machine tool, the workpiece is supported in a parallel relationship with respect to the support surface. If desired, the angle plate may be turned on its side, e.g. the adjacent side edges of the plates are resting on the support surface. In this attitude, a workpiece mounted in the V-grooves of the angle plates will be supportingly carried in a perpendicular relationship with respect to the support surface.

Therefore, angle plates of the basic type described above while being useful for their intended purpose are limited. For example, vertical adjustment of the workpieces relative to the support surface is possible, but is limited to the amount of vertical movement available, if any, within the V-groove when the angle plate is placed on its side. Further, such angle plates make no provision for adjusting and supporting workpieces in an angular attitude. A workpiece can be clamped in a desired angular attitude to the upstanding plate, but the angular adjustment must be made by some other instrument or device. This, of course, is a time consuming set-up of questionable accuracy and definitely does not lend itself to repeatability as needed in a production environment.

U.S. Pat. No. 3,824,744 discloses an angle plate structure which is designed to increase the versatility of such structures and thus overcome some of the shortcomings of basic angle plates. This prior art angle plate is provided with a right angle web in addition to the right angle plates and the web legs are provided with V-shaped grooves therein, and those V-shaped grooves are primarily intended for clamped attachment of workpieces therein. In addition, the two right angle plates are provided with transverse V-shaped grooves therein and an elongated V-shaped groove in the end edge of one of the plates. All of those V-shaped grooves, that is, the one provided in the plates and the web may be used for positioning the angle plate in an angular attitude relative to a support surface. This is accomplished by placing dowels in two of the V-grooves which lie in the same plane. One of the dowels is placed in direct bearing engagement with the support surface and the other is shimmed relative to that surface with a block or blocks of known dimension. This is a technique commonly used in the machining arts for precision setting of what are commonly referred to as sine bars or sine plates. Briefly, the distance between the two dowels is known and the dimension of the shim or shims is also know. With those two knowns, the angular relationship between the support surface and the surface containing the V-grooves in which the dowels are mounted can be calculated using a known trigonometric formula, or by simply using sine tables that are usually available in machine shops.

From the above, it will be seen that this particular prior art angle plate, in effect, becomes a sine plate when used in the manner described above. However, when so used, it is sometimes difficult if not impossible to bolt, clamp or otherwise attach the angle plate to the work surface, with the degree of difficulty increasing when relatively large angles are involved.

In addition, this prior art angle plate is provided with a plurality of precisely located holes in one of the plates for selective placement of a pair of dowels therein. The dowels are positionable in predetermined angular relationships and shim blocks can be employed in conjunction therewith for setting other angular relationships and a sine bar is supported on the dowels. When the sine bar is adjusted in this manner, a workpiece is supported on the upper surface of the sine bar and is clamped to the adjacent surface of the angle plate. Even though this prior art angle plate is provided with this latter sine bar workpiece adjusting capability, it is limited as to its ability for precision holding of workpieces relative to the sine bar in that the workpiece is clampingly attached to the angle plate rather than directly to the sine bar. For example, cylindrical, and relatively small, workpieces cannot be accurately positioned relative to such a structure and accurate repeatable workpiece positioning for production purposes in difficult, if not impossible. Additionally, some workpieces cannot be held at all in this manner due to the interference with the adjacent angle plate.

Therefore, a need exists for a new and improved angle plate apparatus with precisely adjustable workpiece holder which overcomes some of the problems and shortcomings of the prior art.

SUMMARY OF THE INVENTION

In accordance with the present invention, a new and improved multi-purpose angle plate apparatus is provided with a precisely adjustable workpiece holder. The angle plate includes a pair of plates which are disposed at a right angle with respect to each other and are precisely made, as is customary, to allow the angle plate to be used in the normal manner. A V-groove arrangement is formed in the end edge of one of the plates for clamped attachment of workpieces thereto in the usual manner. However, the angle plate is provided with means for demountably and adjustably receiving a V-block means which cooperatively interacts with the V-groove arrangement for aiding in the support of workpieces, for accurately and repeatably positioning multiple workpieces for production purposes, and for rotational orientation of special types of workpieces such as cylindrical workpieces having a cross bar on one end.

One of the plates of the angle plate apparatus is provided with means for mounting a special sine bar workpiece holder thereon. The holder is selectively mountable at various locations along the length of the plate and is pivotably relocatable in desired angular attitudes on that plate. In situations where precision accuracy is not required, the sine bar workpiece holder can be set at a desired angle by visual alignment thereof with an arcuate scale provided on the means for mounting the sine bar workpiece holder on the angle plate. When precision angular settings are required, the pivot point of attachment of the sine bar workpiece holder defines one end of one of the known distances required in calculating the sine function, and a dowel selectively positioned in one of a plurality of incrementally spaced holes provided in the angle plate, defines the other end of that known dimension. A shim block, or blocks, of known thickness are used between the dowel and the sine bar workpiece holder to provide the other known dimension necessary for determining the precise angle of the sine bar workpiece holders.

The sine bar workpiece holder is provided with a V-block protruding from one of its surfaces for clamped attachment of a workpiece thereto. The sine bar workpiece holder may be attached, in the above described manner, so that the V-block is either parallel with or perpendicular to the surface of the plate of the angle plate to which it is attached so that the prior art problem of structural interference is avoidable.

The sine bar workpiece holder is also provided with means for demountably and adjustably attaching the hereinbefore described V-block means thereto so that it can be used as an aid for supporting a workpiece, as a fence, or stop, or for rotational workpiece positioning. The sine bar workpiece holder is also provided with means for demountably carrying a fence means which is adjustable longitudinally relative thereto.

As part of the combination of the present invention, a special grind stone dressing device for demountable clamped attachment in either the V-grooves provided on the angle plate itself or in the V-block of the sine bar workpiece holder in the event that angular orientation of the dressing device is desired or needed. The grind stone dressing device includes a housing having an axial bore in which a cylindrical bar is reciprocally mounted. The extending end of the bar is adapted to carry a tool bit, diamond, carbide or the like, therein and the bar is manually movable for precision dressing of a grind stone.

Accordingly, it is an object of the present invention to provide a new and improved multi-purpose angle plate apparatus with precisely adjustable workpiece holder.

Another object of the present invention is to provide a new and improved structure of the above described character wherein the workpiece holder can be adjustably set at various positions along the length of one of the plates of the angle plate.

Another object of the present invention is to provide a new and improved structure of the above described character including sine bar adjusting means by which the workpiece holder can be adjustably set in precision angular attitudes on the angle plate.

Another object of the present invention is to provide a new and improved structure of the above described character wherein the workpiece holder can be attached in various positions on the angle plate to increase the workpiece holding capability of the workpiece holder to eliminate, or at least reduce workpiece interference with the angle plate.

Another object of the present invention is to provide a new and improved apparatus of the above described character wherein means are provided for demountable and adjustable positioning of a V-block means for workpiece supporting, rotational orientation, and repeatable workpiece positioning on either the angle plate, or on the adjustably positionable workpiece holder.

Another object of the present invention is to provide a new and improved structure of the above described character which further includes, in combination, a grind stone dressing device which can be mounted on either the angle plate or the workpiece holder.

The foregoing and other objects of the present invention as well as the invention itself may be more fully understood from the following description when read in conjunction with the accompanying drawings.

DESCRIPTION OF THE PREFERRED EMBODIMENT

Figure 3:
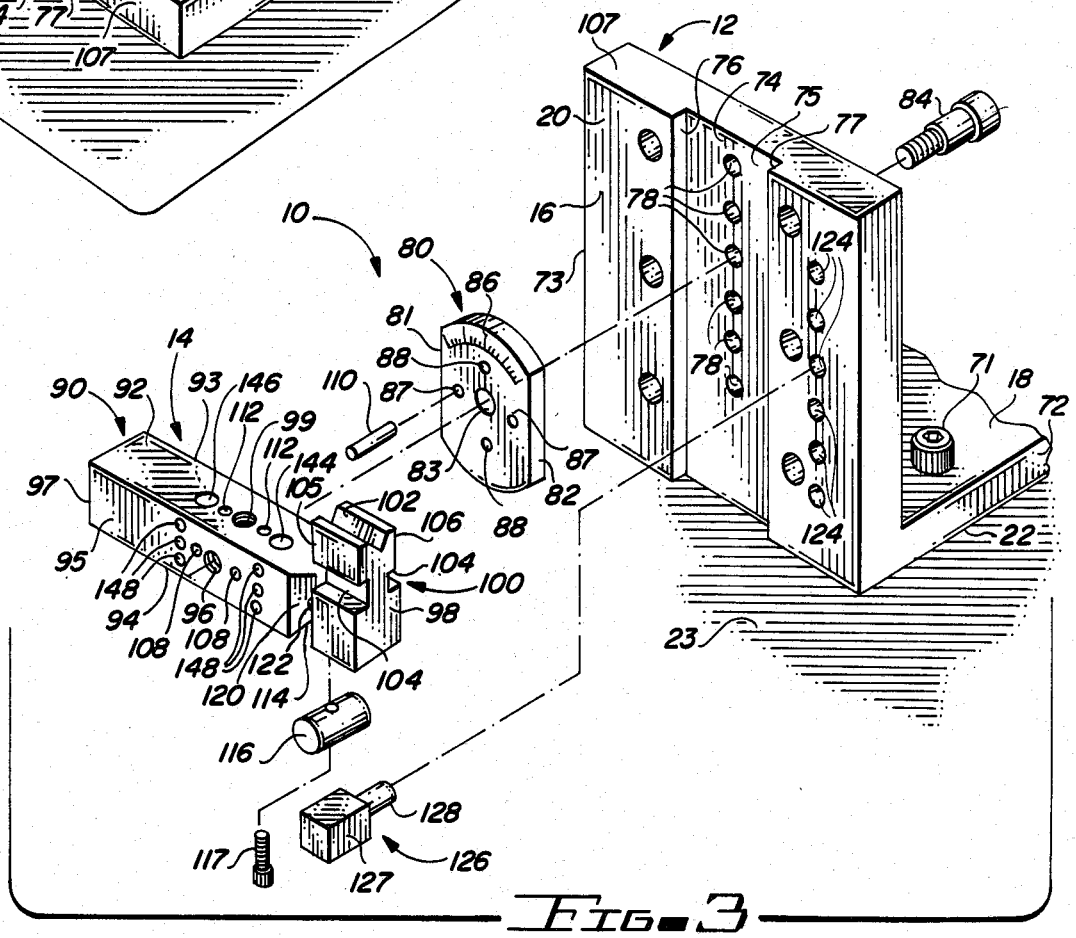
FIG. 3 is a perspective view showing a portion of the angle plate and showing the sine bar workpiece holder and mounting means in exploded relationship therewith.

References made now in particular to FIG. 3 wherein the multi-purpose angle plate apparatus with a precisely adjustable workpiece holder is indicated in its entirety by the reference numeral 10. As will hereinafter be described in detail, the apparatus 10 includes the major parts of an angle plate means 12 and the adjustably positionable workpiece holder 14.

The angle plate 12 is of generally known basic configuration in that it includes a first plate 16 and a second plate 18 both of which are of quadrangular configuration with equal angles, e.g. square or rectangular, and which are integrally formed and disposed at a right angle with respect to each other. The angle plate 12 is a precision structure with regard to parallelism of its side edges, overall squareness, surface flatness and the like. The precision of the angle plate 12 allows it to be used in multiple functions relating to the machining arts, and among those functions is the holding of workpieces so that various machining operations can accurately be accomplished thereon, and the holding of tools, such as grind stone dressing bits and the like.

Figure 1:
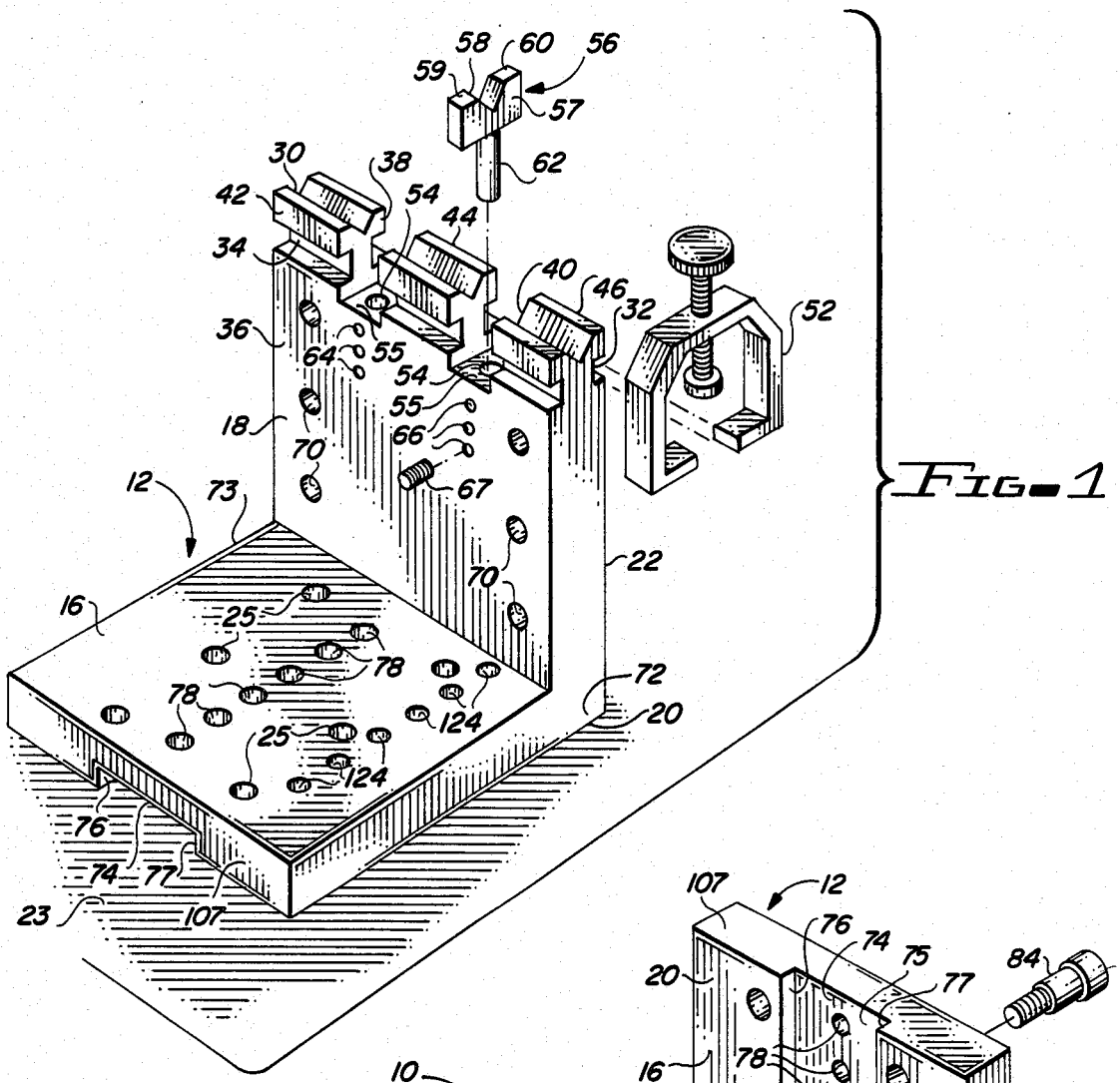
FIG. 1 is a perspective view of the angle plate portion of the apparatus of the present invention with an adjustable V-block means being shown in exploded relationship therewith and also showing a typical workpiece clamp for use therewith.

One of the high precision features of the angle plate 12 is that the surface 20 of plate 16 and the surface 22 of plate 18 are in a precise right angular relationship with respect to each other. Therefore, when the angle plate 12 is resting, or suitably attached, such as by bolts (not shown) passed through selected ones of a plurality of apertures 25 formed through the plate 16, on a suitable supporting surface 23 with the surface 20 of the plate 16 in contiguos engagement with the supporting surface 23, as shown in FIG. 1, the plate 18 is in precise perpendicular relationship with the support surface, and the same is true for plate 16 when the plate 18 is lying on or attached to the support surface.

A V-groove 30 is formed along the length of the extending end edge of the plate 18 and a groove 32 of substantially C-shape in cross section is formed transversely in the surface 22 of the plate in parallel spaced relationship with the end edge of the plate. An identical groove 34 is formed transversely in the opposite surface 36 of the plate 18, and this latter groove is also in parallel spaced relationship with the end edge of the plate. A spaced apart pair of slots 38 and 40 are formed in the plate 18 so as to extend normally from the end edge thereof and those slots interrupt the V-groove 30 and the grooves 32 and 34. Therefore, the slots 38 and 40 divide the end edge of the plate 18 into what may be described as fixed V-blocks 42, 44 and 46 each having its workpiece locating V-groove and each having clamp receiving grooves.

Figure 2:
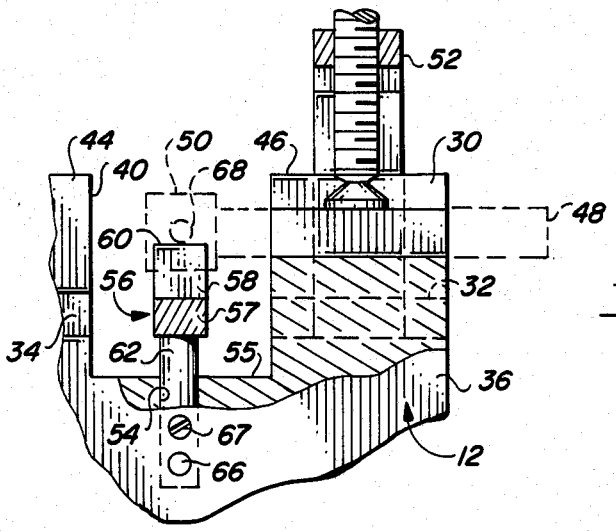
FIG. 2 is an enlarged fragmentary side view of a portion of the angle plate shown in FIG. 1, with the V-block means being shown in a position useful for rotational orientation of a workpiece which is shown in dashed lines.

The slots 38 and 40 that divide the end edge of the plate 18 into the V-blocks 42, 44 and 46 allow relatively small workpieces, such as that shown in dashed lines at 48 in FIG. 2, to be held by the V-blocks when such a workpiece has an enlarged head 50. Such workpieces may be clampingly held in a selected one, or more, of the fixed V-blocks 42, 44 and 46, such as by means of the typical clamp 52.

A blind bore 54 is formed in each or the bight surfaces 55 of the slots 38 and 40 and those bores 54 are normal with respect to the bight surfaces 55 and to the interrupted V-groove 30 formed in the end edge of the plate 18.

A demountably adjustable V-block means 56 is provided as part of the combination of the present invention. The V-block means 56 includes a body 57 having a V-groove 58 formed therein so as to open onto one of the edges of the body intermediate the opposite ends of that edge so as to provide land surfaces 59 and 60 on opposite sides of the V-groove. A cylindrical bar, or shank 62 extends normally from the opposite edge of the body 57 and that shank 62 is sized so as to be axially slidably receivable in either one of the bores 54. An aligned plurality of threaded bores 64 are formed in the plate 18 so as to extend from the surface 36 and transversely intersect the bore 54 formed in the bight surface 55 of the slot 38 and a similar plurality of threaded bores 66 are also formed in the plate 18 so as to transversely intersect the bore 54 of the slot 40. Each of the bores 64 and 66 are intended for selectively receiving a set screw 67 for engaging the shank 62 of the V-block means 56 and thereby setting it in any desired axially extending position relative to the bores 54.

The demountably adjustable V-block means 56 may be used to support the enlarged head 50 of the relatively small workpiece 48 so as to dampen vibrations and otherwise prevent undesirable movements which may result from machining operations to be accomplished on the workpiece. Also, when the workpiece 48 is provided with a crossbar as indicated at 68, the V-block means 56 may be axially adjusted so that the crossbar 68 is restingly supported on the land surfaces 59 and 60 of the V-block body 57 and thereby provide for rotational orientation of the workpiece. Further, the V-block means 56 may be used as a fence, or stop, to allow precision positioning of multiple workpieces as needed in a production situation.

In addition to the above, the plate 18 is provided with a plurality of hole means 70 formed therethrough to allow the angle plate 12 to be secured, such as by the capscrew 71 (FIG. 3) to support surface 23 when the surface 22 of the plate 18 is in engagement with the support surface.

In veiw of the above, it will now be seen that workpieces carried in one or more of the segments of the V-groove 30 will be held in parallel relationship with respect to the surface 20 of the plate 16 and thus in parallel relationship with the support surface 23 when the angle plate 12 is disposed as shown in FIG. 1. It will also be appreciated that a workpiece held in this same manner in the V-groove 30 can be disposed in a perpendicular attitude with respect to the support surface 23 by simply laying the angle plate 12 over on either of its side edges 72 or 73 thereof.

As seen best in FIG. 3, the surface 20 of the plate 16 of the angle plate 12 is provided with a channel 74 extending longitudinally thereof and that channel is formed with a flat bottom surface 75 extending between side edges 76 and 77. A plurality of apertures 78 are formed through the bottom 75 of the channel 74 and are aligningly disposed in spaced increments along the length thereof.

The precisely adjustable workpiece holder 14, as seen best in FIG. 3, is provided with a mounting means which includes a washer means 80 having a thickness dimension equal to the depth of the channel 74 and having flats 81 and 82 formed on the opposite sides thereof so that the washer can be demountably and yet snugly located in the channel 74 provided in the plate 16. The washer is further provided with a smooth bore central aperture 83 so that a suitable bolt, such as that shown at 84, can be selectively passed through one of the plural apertures 78 provided in the bottom 75 of the channel 74, and passed through the central aperture 83 of the washer 80 for precision location of the washer in various locations along the length of the channel.

As will hereinafter be described, the washer 80 is further provided with an arcuate scale 86, and a first pair of relatively small apertures 87 which are aligned transversely, e.g. between the flats 81 and 82 of the washer, and a second pair of similar apertures 88 which are aligned along an imaginary line which is centrally located and parallel to the flats 81 and 82 of the washer.

The workpiece holder means 14 hereinafter referred to as a sine bar workpiece holder for reasons which will become apparent as this description progresses, includes an elongated bar, or body 90 preferably of square cross section so as to have side surfaces 92, 93, 94 and 95 which are formed with precision flatness, squareness, and the like. The body 90 is provide with a first internally threaded aperture 96 intermediate its opposite ends 97 and 98 with that aperture extending between the surfaces 93 and 95 of the body. The body 90 is also provided with a similar internally threaded aperture 99 which extends between the surfaces 92 and 94 of the sine bar body 90 and is disposed along the length thereof so as to intersect the first aperture 96.

A fixed V-block structure 100 is integrally formed on the sine bar body 90 so as to extend normally from the surface 92 at the end 98 of the sine bar body. The V-block structure 100 includes a V-groove 102 on its extending edge and a pair of flat bottom grooves 104 formed in the opposite sides 105 and 106 thereof in spaced parallel relationship with the V-groove 102. It will be noted that the width dimension, e.g. the distance between the sides 105 and 106 of the V-block 100, is less than the width dimension of the body 90, e.g. the distance between the surfaces 93 and 95 thereof. This allows a clamp, such as that shown at 52 in FIG. 1, to be used to hold workpieces in the block 100 without the legs protruding beyond the surfaces 93 and 95 of the sine bar body 90.

As hereinbefore described, the bolt 84 is passed through one of the plural apertures 78 provided in the channel 74 and through the central aperture 83 of the washer 80. When installed in this manner, the threaded end of the bolt 84 is threadingly engagable with either the first threaded aperture 96 or the second threaded aperture 99 provided in the sine bar workpiece holder 14. When the bolt 84 is in threaded engagement with the aperture 96, the sine bar workpiece holder 14 will have its surface 93 in engagement with the surface 20 of the plate 16 and the V-block 100 of the holder will be disposed in parallel relationship with the plate 16 and will extend from the sine bar body 90 toward the extending end edge 107 of the plate 16 of the angle plate 12. It will be noted that by threadingly engaging the bolt 84 in the aperture 96 from the opposite direction, the surface 95 would be in engagement with the surface 20 of the plate 16 and the V-block 100 would face in the opposite direction, that is, away from the edge 107 of the plate.

An alternate method for mounting the sine bar workpiece holder means 14 is usable, for example, when relatively large workpieces are to be held thereby and those workpieces would otherwise extend laterally from the V-block 100 into interfering engagement with the surface 20 of the plate 16. The alternate mounting method is to threadingly engage the bolt 84 with the second threaded aperture 99 provided in the sine bar body 90 so that the surface 94 of the body is brought into bearing engagement with the surface 20 of the plate 16. In this position (not shown) the V-block 100 is disposed so as to be in precise perpendicular relationship with respect to the plate 16.

In either of the above described mounting methods, it will be seen that the sine bar workpiece holder 14 can be pivotably moved about the axis of the bolt 84 when the bolt is loosened and is held in any rotated position about the pivot axis of the bolt by tightening of the bolt. As is known however, tightening of a single bolt in this manner is not a positive locking technique and the sine bar holder means could be unintentionally moved from a desired position during a machining operation.

One of the contemplated uses of the sine bar holder means 14 is to selectively adjustably position it in either a precisely parallel or perpendicular attitude relative to the channel 74 formed in the plate. In other words, in a vertical attitude or a horizontal attitude relative to the support surface 23 when the plate 13 is supported thereon. In order to lock the sine bar workpiece holder 14 in either the horizontal or vertical attitudes, the sine bar body 90 is provided with a pair of relatively small apertures 108 on diametrically opposed sides of the threaded aperture 96 provided in the body 90. When the sine bar workpiece holder 14 is positioned as shown in FIG. 3, e.g. in a horizontal attitude relative to the support surface 23, the apertures 108 will align with the apertures 87 provided in the washer 80 and a pair of suitable dowel pins 110 (one shown) are demountably inserted in those aligned apertures. When the sine bar body 90 is rotated counterclockwise through 90° from the position shown in FIG. 3 into a vertical attitude relative to the support surface 23, the apertures 108 will be in alignment with the apertures 88 provided in the washer 80 and the dowel pins 110 (one shown) can be used in the above described manner to lock the sine bar workpiece holder 14 in the vertical attitude.

It will be noted that a pair of relatively small apertures 112 are similarly provided on diametrically opposed sides of the second threaded aperture 99 of the sine bar body 90. This second pair of apertures 112 are used, along with the dowel pins 110 (one shown) to positively fix the sine bar workpiece holder 14 in either the horizontal or vertical attitudes when the workpiece holder 14 is mounted in the hereinbefore described alternate manner.

In either case, when the sine bar holder means 14 is mounted in the horizontal or vertical attitudes, the holder means 14 can be adjustably positioned along the length of the channel 74 by selective placement of the bolt 84 in desired ones of the apertures 78 provided in the bottom surface 75 of the channel 74. Therefore, a workpiece carried in the V-block 100 of the sine bar body 90 can be adjusted vertically relative to the support surface 23 in either of the vertical or horizontal attitudes of the workpiece holder means 14. In addition, a workpiece can be adjusted laterally of the angle plate 12, if desired, by placing the angle plate on either one of its side edges 72 or 73.

Figure 4:
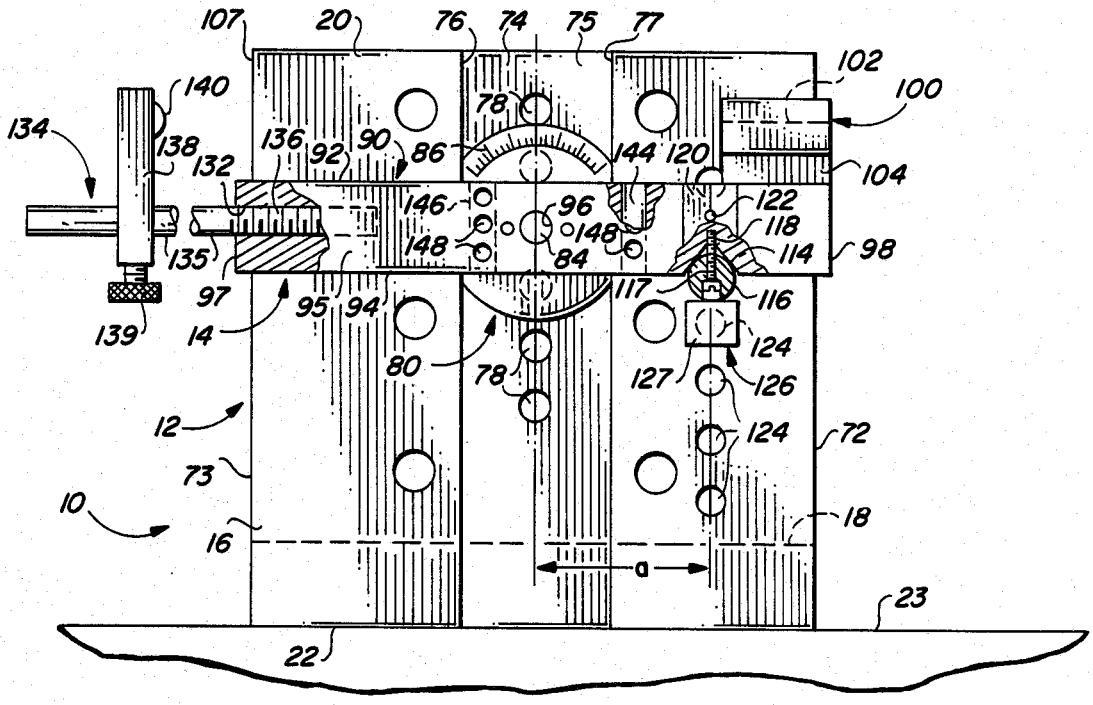
FIG. 4 is an elevational view of the apparatus of the present invention showing the sine bar workpiece holder in a position wherein it is parallel with respect to a support surface upon which the apparatus is supported.
Figure 5:
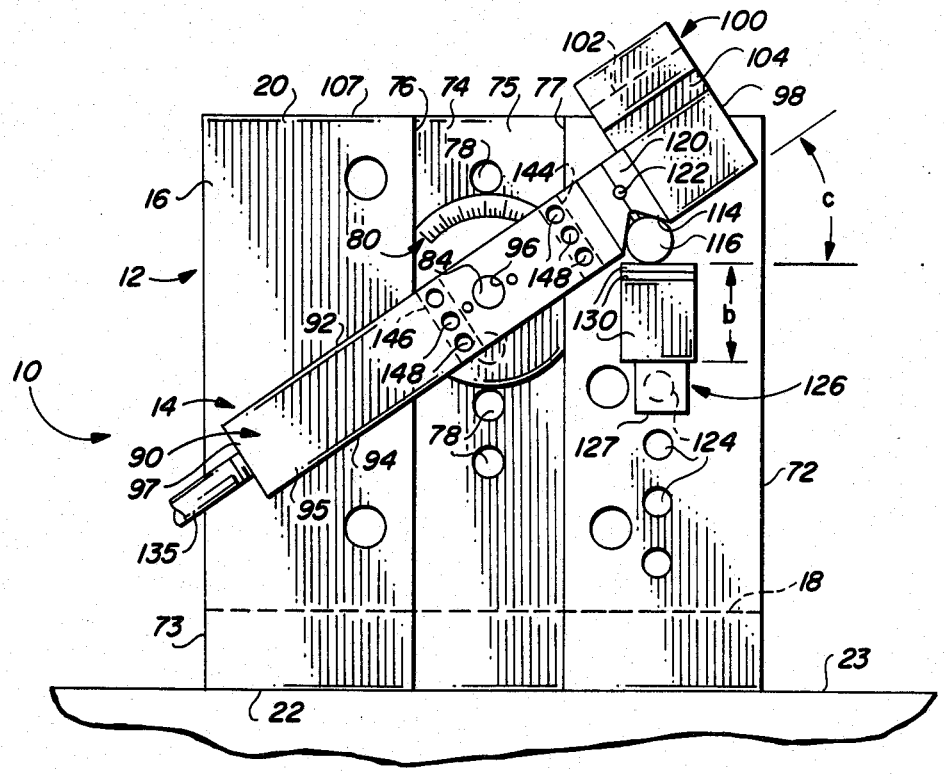
FIG. 5 is an elevational view similar to FIG. 4 but showing the sine bar workpiece holder in an angularly adjusted position relative to the support surface upon which the apparatus is supported.

As seen best in FIGS. 4 and 5, the sine bar body 90 is provided with a V-groove 114 which extends transversely of surface 94 thereof. A precision dowel pin 116 is demountably positioned in the V-groove 114 such as by means of a suitable bolt 117 which passes transversely through the pin 116 into threaded engagement with a suitable internally threaded bore 118 formed in the V-groove. Also, a similar V-groove 120 is formed transversely of the surface 95 of the sine bar body 90 and an internally threaded bore 122 is similarly formed in that V-groove. The dowel pin 116 may be selectively mounted in the V-groove 114 as shown, or in the other V-groove 120 so that the workpiece holder 14 can be accurately set at desired angles by the well known technique sometimes referred to as the "sine bar" technique.

To accomplish the sine bar technique for angularly setting the workpiece holder 14, a plurality of precisely located apertures 124 are provided in spaced increments in the plate 16 of the angle plate 12, and those apertures are in aligned with respect to each other along a line which is parallel to the apertures 78 provided in the bottom 75 of the channel 74. This precision parallel relationship establishes a known distance "a" between the apertures 78 and the apertures 124 and that distance is a constant. A positioning block means 126 having a square body 127 with a cylindrical shank 128 extending therefrom is selectively positionable in a desired one of the apertures 124.

For precision adjustable positioning of the workpiece holder 14 in a horizontal attitude relative to the support surface 23 when the plate 18 is supported flat on the surface 23, the sine bar body 90 is rotated about the pivot axis of the bolt 84 until the dowel pin 16 is in bearing engagement with an upwardly facing surface of the body 127 of the positioning block means 126. Then to arrive at a desired angular attitude, a shim block or blocks 130 are interposingly placed between the positioning block 126 and the dowel pin 116 until a desired distance "b" is achieved. With the distances "a" and "b" being known, the sine of the angle "c" and thus the angle itself is known in accordance established trigonometric principles.

In that the workpiece holder 14 means is adjustably positioned in desired one of the apertures 78 provided in the channel 74 and the positioning block means 126 is adjustably positionable in desired ones of the apertures 124, the above described sine bar angular adjustment techniques can be used regardless of the location of the workpiece holder 14 in the channel.

The above described precision angular adjustment of the sine bar workpiece holder 14 may not always be needed in that in some instances, a high degree of precision may not be required. In such cases, the surface 92, or the surface 93, depending on which apertures 96 or 99 are used to mount the body 90 on the plate 16, may be visually aligned with the arcuate scale 86 provided on the washer 80 to make a non-precision angular setting of the workpiece holder 14.

As seen in FIG. 4, an internally threaded bore 132 is formed in the end surface 97 of the sine bar body 90. That bore 132 is used for demountable attachment of an adjustable fence, or stop, means 134 on the workpiece holder 14. The fence means 134 may include an elongated rod 135 having a threaded end 136 for mounting in the bore 132, and further includes a plate 138 which is slidably positionable along the length of the rod 135. The plate 138 includes a thumb screw 139 by which it is lockably set at a desired position on the rod 135, and a hemispherical protrusion 140 is provided on the plate for engaging, and therefore precisely and repeatedly positioning plural workpieces in a production situation.

The hereinbefore described demountably adjustable V-block means 56 (FIG. 1) in addition to its use in conjunction with the V-blocks 42, 44 and 46 provided on the plate 18, can also be used in the same manner on the sine bar body 90. For this purpose, a first blind bore 144 and a second blind bore 146 are spacedly arranged with respect to each other in surface 92 of the sine bar body. A plurality of internally threaded bores 148 are formed in the surface 95 of the sine bar body 90 so as to transversely intersect the first and second bores 146 and 148, and the set screw 67 (FIG. 1) may be located in any one of the bores 148 to fix the V-block means 56 in the desired one of the bores 144 and 146 and set the normally extending position of the V-block means 56 relative to the sine bar body 90.

Figure 6:
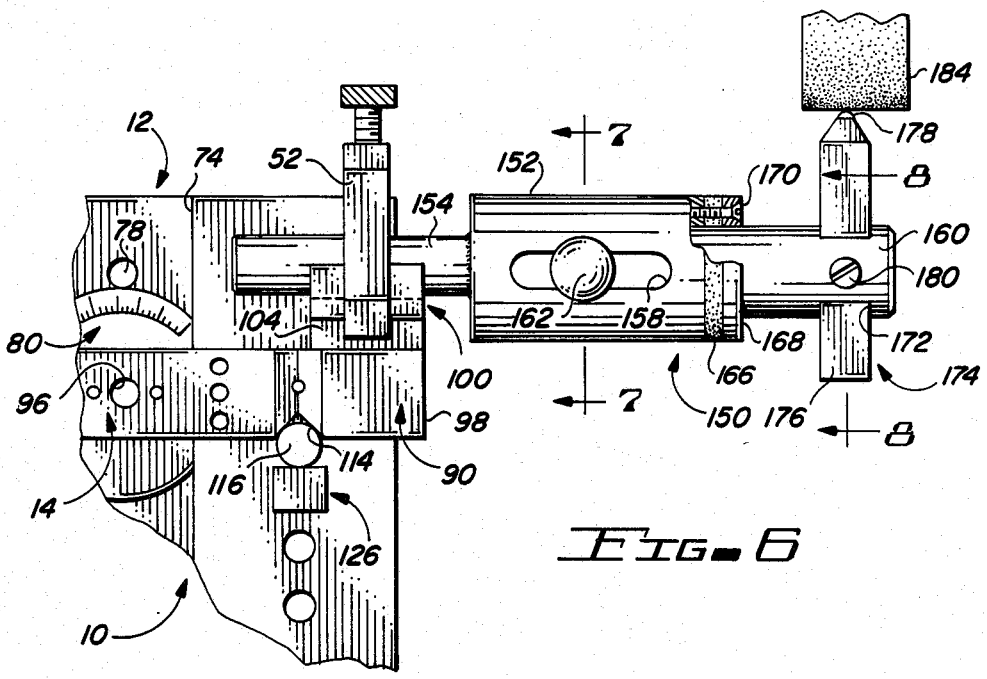
FIG. 6 is an enlarged fragmentary view showing the grinding wheel dressing device of the present invention being mounted on the sine bar workpiece holder.
Figure 7:
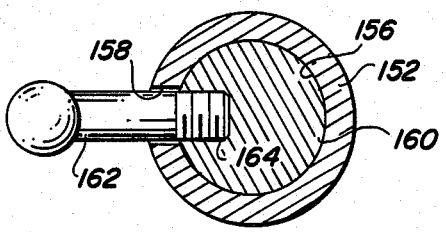
FIG. 7 is a sectional view taken along the line 7—7 of FIG. 6.
Figure 8:
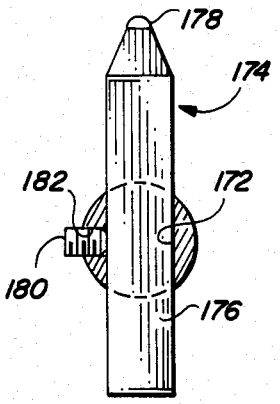
FIG. 8 is a sectional view taken along the line 8—8 of FIG. 6.

Referring now to FIGS. 6, 7 and 8 wherein a special grind stone dressing tool 150 is shown and its usage with the sine bar workpiece holder means. The dressing tool 150 includes a housing 152 having a reduced diameter shank 154 extending axially from one end thereof by which the housing may be attached to the block 100 of the workpiece holder 14 by means of the clamp 52. The housing has a blind cylindrical bore 156 which extends axially therein and opens oppositely of the shank 154 portion of the housing, and an elongated slot 158 is formed in the housing so as to be open laterally relative to the axial bore 156. A cylindrical rod 160 is axially slidably movable in the bore 156 of the housing 152 and such movement is manually and reciprocally accomplished by a handle 162 which is attached as at 164 to the rod and extends laterally therefrom through the slot 158 provided in the housing 152.

A sealing and lubrication washer 166, such as of felt, is coaxially mounted by means of a ring-shaped retainer plate 168 on the open end of the bore 156 of the housing 152. The washer 166 and the retainer plate 168 are mounted on the housing, such as by screws 170 (one shown) and circumscribe the cylindrical rod 160 to prevent grind stone dust from entering the bore 156 of the housing 152 and to provide lubrication which may be in the form of oil applied from time to time to the felt washer.

A transverse slot 172 is formed through the rod 160 proximate its extending end for slidably receiving a suitable bit 174. The bit 174, as in the normal manner, includes a body portion 176 with a carbide or diamond cutter 178 carried on one end thereof. The bit 174 is demountably carried in the transverse slot 172 by means of a set screw 180 that is threadingly movable in a threaded bore 182 which is suitably formed in the rod 160.

By reciprocally moving the rod 160, the cutter 178 can be reciprocally moved relative to a grind stone 184 and thereby dress its peripheral surface. It will be noted that the sine bar workpiece holder 14 may be set at any desired angle, in the manner hereinbefore described, which would, of course, set the dressing tool 150 at the desired angle. This can be employed to form special angles on the periphery of the grind stone so that the stone can be used for special grinding purposes.

While the principles of the invention have now been made clear in the illustrated embodiments, they will be immediately obvious to those skilled in the art, many modifications of structure, arrangements, proportions, the elements, materials, and components used in the practice of the invention, and otherwise, which are particularly adapted for specific environments and operation requirements, without departing from those principles. The appended claims are therefore intended to cover and embrace any such modifications within the limits only of the true spirit and scope of the invention.

What I claim is:

1. An apparatus for adjustable precision positioning and holding of a workpiece comprising:

(a) a first plate defining a planar surface and being of quadrangular configuration having four equal angles and defining an extending edge;

(b) a second plate defining a planar surface said second plate integral with said first plate and disposed at a right angle with respect thereto;

(c) a workpiece holder for adjustable attachment to said first plate, said workpiece holder including an elongated bar having opposite ends and opposed planar surfaces and a fixed V-block means formed integrally on one of the planar surfaces of said bar proximate one of the ends thereof for demountable attachment of a workpiece thereto;

(d) said first plate having a flat bottomed channel formed in the planar surface thereof and extending perpendicularly from the extending edge thereof, said first plate defining a first plurality of apertures disposed in aligned spaced increments along the flat bottomed channel thereof;

(e) a washer in said channel of said first plate and movable along the length thereof, said washer having a central aperture; and (f) mounting means demountably connected to said first plate and to said workpiece holder for attachment of said workpiece holder in contiguous bearing engagement with the planar surface of said first plate, said mounting means including a fastener which is selectively positionable in one of said first plurality of apertures of said first plate and passable through the aperture of said washer, said fastener defining a pivot axis which extends normally from the surface of said first plate and about which said workpiece holder is pivotably movable for angular adjustable positioning thereof on the planar surface of said first plate.

2. An apparatus as claimed in claim 1 and further comprising:

(a) said one of the planar surfaces of said elongated bar having a width dimension; and (b) said fixed V-block means extends normally from the one planar surfaces of said bar, said fixed V-block means having opposite sides with the distance between the opposite sides being less than the width dimension of the one of said planar surfaces of said bar and has means formed on the opposite sides for demountable attachment of a workpiece clamp means thereto.

3. An apparatus as claimed in claim 1 and further comprising:

(a) means on said washer for fixing said washer against rotational movement in the flat bottomed channel of said first plate; and (b) pin means for selectively interconnecting said washer means and said bar in a first relationship for releasably fixing said bar against pivotable movement in a first position wherein said bar is perpendicular with respect to the extending edge of said first plate and in a second relationship for releasably fixing said bar against pivotable movement in a second position wherein said bar is parallel with respect to the extending edge of said first plate.

4. An apparatus as claimed in claim 1 and further comprising (a) said fastener having a threaded end which extends normally from the central aperture of said washer;

(b) said bar having a first threaded bore for selectively engaging the threaded end of said fastener means for mounting said bar in a first attitude wherein said V-block means lies in a plane parallel to the planar surface of said first plate; and (c) said bar having a second threaded bore for selectively engaging the threaded end of said fastener means for mounting said bar in a second attitude wherein said fixed V-block means lie in a plane perpendicular to the planar surface of said first plane.

5. An apparatus as claimed in claim 1 and further comprising:

(a) said first plate having a second plurality of apertures disposed in aligned spaced increments with respect to each other with the alignment of said second plurality of apertures being spaced a predetermined distance and parallel with the alignment of said first plurality of apertures of said first plate;

(b) positioning block means selectively demountably carried in one of said second plurality of apertures of said first plate and configured for extending normally from the planar surface of said first plate; and (c) said positioning block means being selectively mounted in one of said second plurality of apertures of said first plate which results in supportingly positioning said elongated bar in an attitude which is parallel with the extending edge of said first plate when said elongated bar is pivotably moved about the pivot axis defined by said fastener means into bearing engagement with said positioning block means.

6. An apparatus as claimed in claim 5 and further comprising at least one shim block of known thickness dimension interposable between and in engagement with said positioning block means and said elongated bar for supportingly positioning said elongated bar in a precise angular attitude on the planar surface of said first plate.

7. An apparatus as claimed in claim 1 and further comprising:

(a) said second plate being of quadrangular configuration having four equal angles and defining an extending end edge; and (b) said second plate having at least two spaced slots formed in the extending end edge defined thereby to divide the extending end edge into three separated segments each of which is configured in the form of a fixed V-block for precision supporting of a workpiece.

8. An apparatus as claimed in claim 7 wherein each of said fixed V-blocks is provided with means for demountably receiving a clamp for clamped holding a workpiece therein.

9. An apparatus as claimed in claim 7 and further comprising adjustably movable V-block means selectively mountable in either of said two slots formed in the extending end edge defined by said second plate so as to extend therefrom in a normal attitude with respect to the extending end edge defined by said second plate, said adjustably movable V-block means being adjustable as to its extending position of aiding in the support of a workpiece and being usable as a fence for precision repeatable multiple workpiece positioning in production situations.

10. An apparatus as claimed in claim 1 and further comprising a grind stone dressing tool demountably held in said workpiece holder means and movable therewith into said various angularly adjustable positions relative to the planar surface of said first plate.

11. An apparatus as claimed in claim 10 wherein said grind stone dressing tool comprises:

(a) a housing defined a cylindrical bore which opens onto one end thereof;

(b) a cylindrical rod axially slidably movable in the bore of said housing and having an extending end;

(c) a grinstone bit; and (d) said cylindrical rod having means formed proximate its extending end for demountably carrying said grindstone bit.

12. An apparatus as claimed in claim 11 and further comprising:

(a) said housing having a closed ended slot extending laterally from the cylindrical bore thereof; and (b) a handle extending radially from said cylindrical rod through the slot of said housing for manual reciprocal movement of said rod in the bore of said housing.

13. An apparatus for adjustable precision positioning and holding of a workpiece comprising:

(a) a first plate defining a planar surface;

(b) a second plate defining a planar surface said second plate integral with said first plate and disposed at a right angle with respect thereto;

(c) a workpiece holder for adjustable attachment to said first plate and including an elongated bar having opposite ends and opposed planar surfaces and a fixed V-block means formed integrally on one of the planar surfaces of said bar proximate one of the ends thereof for demountable attachment of a workpiece to said bar;

(d) mounting means demountably connected to said first plate and to said workpiece holder for attachment of said workpiece holder in contiguous bearing engagement with the planar surface of said first plate, said mounting means defining a pivot axis which extends normally from the surface of said first plate and about which said workpiece holder is pivotably movable for angular adjustable positioning thereof on the planar surface of said first plate; and (e) a second V-block means demountably attachable to the one planar surface of said bar in spaced relationship with said fixed V-block means, said second V-block means extending normally from the one planar surface of said bar when mounted thereon and adjustable as to its extended position, said second V-block means being for aiding said fixed V-block means in supporting of a workpiece and being usable as a fence for precision repeatable multiple workpiece positioning in production situations.

14. An apparatus as claimed in claim 13 wherein said bar of said workpiece holder further comprises:

(a) first means formed in said bar intermediate the opposite ends thereof for selective demountable connection of said mounting means to said bar for attachment of said bar to said first plate in a first attitude wherein said fixed V-block means lies in a plane parallel to the planar surface of said first plate; and (b) second means formed in said bar intermediate the opposite ends thereof for selective demountable connection of said mounting means to said bar for attachment of said bar to said first plate in a second attitude wherein said fixed V-block means lies in a plane perpendicular to the planar surface of said first plate.

15. An apparatus as claimed in claim 13 and further comprising:

(a) said first plate being of quadrangular configuration with four equal angles and defining an extending end edge and having at least one aperture formed therein in predetermined spaced relationship with the pivot axis defined by said mounting means; and (b) positioning block means demountably carried in the aperture of said first plate and configured for extending perpendicularly from the planar surface of said first plate for supportingly positioning said elongated bar in an attitude parallel with the extending end edge defined by said first plate when said elongated bar is pivotably moved about the pivot axis defined by said mounting means into bearing engagement with said positioning block means.

16. An apparatus as claimed in claim 15 and further comprising at least one shim block of known thickness dimension interposable between and in engagement with said positioning block means and said elongated bar for supportingly positioning said bar in a precise angular attitude on the planar surface of said first plate.

* * * * *